United States Patent [19]

Ikeda et al.

[11] Patent Number: 5,071,727

[45] Date of Patent: Dec. 10, 1991

[54] POSITIVELY CHARGEABLE ELECTROSTATIC TONER CONTAINING ORGANIC METAL COMPLEX OR ORGANIC NITROGEN, PHOSPHINO OR METAL COMPOUND

[75] Inventors: Takeshi Ikeda, Yokohama; Eiichi Imai, Narashino; Hiroshi Fukumoto, Kawasaki; Katsuhiko Tanaka, Tokyo; Koshi Suematsu, Kawasaki; Motoo Urawa, Tokyo; Masanori Takenouchi, Atsugi, all of Japan

[73] Assignee: Canon Kabushiki Kaisha, Tokyo, Japan

[21] Appl. No.: 552,859

[22] Filed: Jul. 11, 1990

Related U.S. Application Data

[63] Continuation of Ser. No. 391,666, Aug. 8, 1989, abandoned, which is a continuation of Ser. No. 73,848, Jul. 14, 1987, abandoned, which is a continuation of Ser. No. 789,015, Oct. 18, 1985, abandoned.

[30] Foreign Application Priority Data

| | | | |
|---|---|---|---|
| Oct. 19, 1984 | [JP] | Japan | 59-220987 |
| Oct. 19, 1984 | [JP] | Japan | 59-220988 |
| Oct. 19, 1984 | [JP] | Japan | 59-220989 |
| Oct. 22, 1984 | [JP] | Japan | 59-222658 |
| Apr. 26, 1985 | [JP] | Japan | 60-088875 |
| May 14, 1985 | [JP] | Japan | 60-101749 |
| May 28, 1985 | [JP] | Japan | 60-115773 |

[51] Int. Cl.[5] ..... G03G 9/097; G03G 13/08

[52] U.S. Cl. ..... 430/110; 430/111; 430/120; 430/945

[58] Field of Search ..... 430/102, 110, 111, 120

[56] References Cited

U.S. PATENT DOCUMENTS

| | | | |
|---|---|---|---|
| 3,944,493 | 3/1976 | Jadwin et al. | 430/110 X |
| 4,085,057 | 4/1978 | Masuda et al. | 430/110 |
| 4,248,954 | 2/1981 | Datta et al. | 430/97 |
| 4,265,995 | 5/1981 | Mammino | 430/108 X |
| 4,271,249 | 6/1981 | Gilliams et al. | 430/102 X |
| 4,312,933 | 1/1982 | Lu | 430/110 X |
| 4,404,270 | 9/1983 | Higashida et al. | 430/110 |
| 4,537,848 | 8/1985 | Yourd et al. | 430/110 |
| 4,554,233 | 11/1985 | Hashimoto et al. | 430/110 X |
| 4,663,263 | 5/1987 | Ikeda et al. | 430/110 |

FOREIGN PATENT DOCUMENTS

| | | | |
|---|---|---|---|
| 2606749 | 9/1976 | Fed. Rep. of Germany | 430/110 |
| 48-43158 | 12/1973 | Japan | 430/110 |
| 57-79964 | 5/1982 | Japan | 430/110 |
| 59-100455 | 6/1984 | Japan | 430/110 |
| 59-177566 | 10/1984 | Japan | 430/110 |
| 59-195661 | 11/1984 | Japan | 430/110 |
| 1375814 | 11/1974 | United Kingdom . | |

*Primary Examiner*—Roland Martin

*Attorney, Agent, or Firm*—Fitzpatrick, Cella, Harper & Scinto

[57] ABSTRACT

A triboelectrically chargeable composition for use in development of electrostatic latent images. The composition comprises a positively chargeable compound and a base material carrying the positively chargeable compound. The positively chargeable compound has an oxidation potential of 750 mV or below, a whiteness W of 0.5 or above and an average particle size of 5.0 microns or smaller. The composition is embodied typically as a positively chargeable toner and also as a charge-imparting material for charging a toner. The positively chargeable toner is especially adapted for development of digital latent images, e.g., as produced by laser beam scanning.

16 Claims, 4 Drawing Sheets

POSITIVELY CHARGEABLE ELECTROSTATIC TONER CONTAINING ORGANIC METAL COMPLEX OR ORGANIC NITROGEN, PHOSPHINO OR METAL COMPOUND

This application is a continuation division, of application Ser. No. 391,666 filed Aug. 8, 1989, which is a continuation of application Ser. No. 073,848, filed July 14, 1987, which is a continuation of application Ser. No. 789,015 filed Oct. 18, 1985, all having been abandoned.

FIELD OF THE INVENTION AND RELATED ART

The present invention relates to a toner used in a developer for developing electrostatic images in electrophotography, electostatic recording and electrostatic printing, more particularly to a positively chargeable toner which is uniformly and strongly charged positively to visualize negatively charged electrostatic image or visualize positively charged electrostatic image through reversal development, thereby providing high-quality images.

Further, the present invention relates to an electric charge-imparting material for imparting triboelectric charge to a developer for developing electrostatic images in electrophotography, electrostatic recording and electrostatic printing.

Furthermore, the present invention relates to a triboelectrically chargeable composition for use in development of electrostatic images to form a visible image in electrophotography, electrostatic recording and electrostatic printing.

Hitherto, a large number of electrophotographic processes have been known, as disclosed in U.S. Pat. Nos. 2,297,691; 4,071,361, and others. Generally speaking, photoconductive materials are utilized in these processes, and the steps included therein comprise forming electrical latent images on photosensitive members by various means, then developing the latent images by using developing powder (frequently called as "toner"), transferring the toner images thus formed to a recording medium such as paper, as desired, and thereafter fixing the images by heating, pressure or solvent vapor to obtain copies. When the step of transferring the toner images is adopted, it is a general practice to provide a step for removing residual toner on the photosensitive member.

The developing methods for visualizing electrical latent images by use of toners known in the art may include, for example, the magnetic brush method as disclosed in U.S. Pat. No. 2,874,063; the cascade developing method as disclosed in U.S. Pat. No. 2,618,552; the powder cloud method as disclosed in U.S. Pat. No. 2,221,776; and the method using conductive magnetic toner as disclosed in U.S. Pat. No. 3,909,258.

As the toner for dry development system to be applied for these developing methods, fine powder of natural or synthetic resins having dyes or pigments dispersed therein has heretofore generally been used. For example, a colorant is dispersed in a binder resin such as polystyrene, and the particles obtained by micropulverizing the resultant dispersion into sizes of about 1 to 30 microns are used as the toner. As the magnetic toner, magnetic particles are further incorporated into the particles as mentioned above. In case of the system employing the two-component developer, the toner as mentioned above is used generally in mixture with carrier particles such as glass beads and iron particles.

For such a toner for dry-system development, it has been becoming a general practice to use a positive or negative charge controlling agent in order to improve the charging characteristic.

Positive charge controllers conventionally used in toners for dry development system, may include, for example, quaternary ammonium compounds and organic dyes, particularly basic dyes and salts thereof including nigrosine base and nigrosin. These charge controllers are usually added to a thermoplastic resin to be dispersed in the resin while it is molten under heating, and the resultant resin mixture is micropulverized into fine particles and, if desired, adjusted to suitable sizes. The conventional charge controllers have been composed of such coarse particles that 30% by number or less thereof have particle sizes which are 1/5 or smaller of the average particle size of the toner to be used in combination.

However, these conventional charge controllers are liable to cause lowering in the charge controlling characteristic, when subjected to mechanical collision and friction during kneading under heat to change in temperature and humidity conditions.

Accordingly, when a toner containing these charge controllers is used in a copying machine to effect development, the toner can cause deterioration during continual use.

Further, these conventional charge controllers, as represented by nigrosine, show dense colors which provide a serious obstacle to formation of toners in bright chromatic colors.

As another serious disadvantage, it is very difficult to disperse these charge controllers evenly into a thermoplastic resin, and their contents in toner particles obtained by pulverization are not constant to result in different amounts of triboelectric charges among the toner particles. For this reason, in the prior art, various methods have been practiced in order to disperse the charge controlling more evenly into a resin. For example, a basic nigrosine dye is formed into a salt with a higher fatty acid for improvement of compatibility with a thermoplastic resin. In this case, however, unreacted fatty acid or decomposed product of the salt will be exposed on the toner surfaces to contaminate carriers or toner carrying member and also cause lowering in free flowing properly of the toner, fog and lowering in image density. Alternatively, for improvement in dispersibility of these dyes into a resin, there is also employed a method in which powder of a charge controller and resin powder are previously mechanically pulverized and mixed before fusion kneading. This method is not competent enough to overcome the original poor dispersibility, and evenness of charging satisfactory in practical application has not yet been obtained.

Uneven or different amounts of charge provided to individual toner particles through friction between toner particles, toner and carrier particles or toner and a toner carrying member such as a sleeve which are liable to result when a conventional charge controller is used in a toner, can provide a serious problem especially when the toner is used for developing electrostatic latent images produced by digital image signals. Where image signals are composed of digital signals, the resultant latent picture is formed by a gathering of dot with a constant potential, wherein the solid, half-tone and highlight portions of the picture can be expressed by varying densities of dots. Accordingly, when binary signals are used to form every portion of a picture, the picture is formed by electrostatic latent images or dots of substantially the same potential. Further, as the desire for further improved quality of picture or image has been becoming intense, the multiple-valued dizza method using ternary or quaternary signals has been desired in place of the binary or two-valued dizza method as described above. The multiple-valued dizza method is also an essential technique in order to remove a false contour which is liable to appear in a highlight portion, or to improve a resolution by decreasing the size of one picture unit without impairing gradational characteristic, when a picture comprising halftone images and line images in mixture is reproduced simultaneously. In a case where an electrostatic latent image provided through digital image signals is visualized by development with a toner, the charging characteristic of the toner is particularly important, and a charge controller having a further improved performance compared with that of the conventional charge controller has been expected.

In order to have a toner acquire an electric charge, a method of utilizing only the triboelectric chargeability of the toner per se has been known as described above. In this method, however, the chargeability of the toner is small unless it contains an appropriate charge controller, the image obtained by such a toner is liable to be accompanied with fog and unclear. For this reason, there has been proposed to impart triboelectric charge by a movement or carriage-regulating member such as magnetic particles, a carrier, a sleeve or a doctor blade, or a developing material or member for charging. The developing material or member for charging is a material or member for imparting or auxiliarily imparting a triboelectric charge to a toner through contact with the toner.

If such a charge-imparting material having a charge imparting ability is used, the necessity for a toner contain an additive for controlling the chargeability of the toner to, i.e. a charge controller, is minimized, whereby contamination of a carrier or a photosensitive member with the additive is minimized. Therefore, lowering of chargeability or disturbance of latent images during a successive copying operation is minimized, so that even a color toner can readily be charged.

However, in order to provide a good charge-imparting property to a movement-regulating material such as magnetic particles, a carrier, sleeve or doctor blade, or a developing member for charging, it is necessary to use a substance or compound which can provide a strong charge-imparting ability and also can be applied or coated onto the material or can be dispersed in the material. In this regard, the carrier particles are generally used for a long period of time without exchange, and the sleeve is used until the main body of a copier cannot be used, so that they must be mechanically tough and durable for a long period of time. Thus, a good additive for improving a charge-imparting characteristic of such a charge imparting for supplementing the chargeability of toner is also expected.

SUMMARY OF THE INVENTION

A principal object of the present invention is to provide a positively chargeable toner which can be provided with a stable amount of and a sharp and uniform distribution of triboelectric charge through friction between toner particles, between toner and carrier or between toner and a toner-carrying member such as a sleeve in case of one-component development system and can be controlled to have a triboelectric charge in an amount adapted to a developing system to be used.

Another object of the present invention is to provide a toner capable of faithfully developing a digital latent image, i.e., a toner which has a large slope on a Vs−Dp curve during development, can provide a large density difference between dots and can sharply reproduce peripheries of dots.

A further object of the present invention is to provide a toner which can retain initial characteristics including a Vs−Dp curve even after a long period of successive use.

Still another object of the invention is to provide a toner which reproduces a stable image without being affected by change in temperature and humidity.

A further object of the invention is to provide a toner with excellent storage stability which can retain initial characteristics even after a long period of storage.

A further object of the invention is to provide a bright chromatic toner.

A still further object of the present invention is to provide a charge-imparting material or member improved in charge-imparting capability for imparting an appropriate amount of negative charge to a toner.

A further object of the invention is to provide an improved charge-imparting material which is less liable to deteriorate in its performance during a long period of use.

A still further object of the invention is to provide a charge-imparting material or member adapted to a chromatic toner.

A generic object of the present invention is to provide of a triboelectrically chargeable composition inclusive of a toner for developing electrostatic images and a charge-imparting material or member with characteristics as described above.

A yet further object of the present invention is to provide an image forming method comprising development of digital latent images.

According to a principal aspect of the present invention, there is provided a positively chargeable toner for developing electrostatic images comprising a binder, a colorant and a positively chargeable compound, the positive chargeable compound having an oxidation potential of 750 mV or below, a whiteness W of 0.5 or above and an average particle size of 5.0 microns or smaller.

According to another aspect of the present invention, there is provided a charge-imparting material comprising the above-mentioned positively chargeable compound and a base material carrying the positively chargeable compound. Herein, the term "charge-imparting material" is intended to cover materials having a function of imparting triboelectric charge to a toner, which are in the form of particles such as magnetic particles or carrier particles used in combination with a toner to form a two-component developer or a solid member such as a doctor blade, a toner-carrying member such as a sleeve, and other members which contact a toner before or during a developing step. The term "carrying" has been used to cover the cases where the positively chargeable compound is dispersed in the base material which may be in the form of particles or a solid member as described above, or carried as a coating on the surface or an embedded substance in the surface layer of the base material.

According to a broader and generic aspect of the present invention, there is provided a triboelectricallly chargeable composition comprising the above mentioned positively chargeable compound and a base material carrying the positively chargeable compound. Herein, the term "composition" has been used to cover the toner and the charge-imparting material as described above. Accordingly, the term "base material" used herein is intended to cover materials in the form of particles inclusive of particles constituting toners and carrier particles. The term "carrying" has the same meaning as described above.

According to a further aspect of the present invention, there is provided an image forming method which comprises: forming a digital electrostatic latent image on a latent image bearing member, and developing the digital latent image with a positively chargeable toner comprising a binder, a colorant and a positively chargeable compound, the positively chargeable compound having an oxidation potential of 750 mV or below, a whiteness W of 0.5 or above and an average particle size of 5.0 microns or smaller.

These and other objects, features and advantages of the present invention will become more apparent upon a consideration of the following description of the preferred embodiments of the present invention taken in conjunction with the accompanying drawings.

DETAILED DESCRIPTION OF THE INVENTION

A more detailed explanation will be made hereinbelow on digital latent images which may be suitably developed with the toner according to the invention.

Figure 1A:
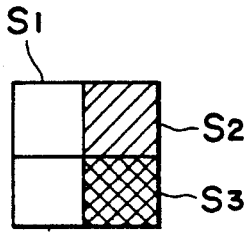
FIGS. 1A and 1B illustrate a concept of a multiple-valued dizza matrix.
Figure 1B:
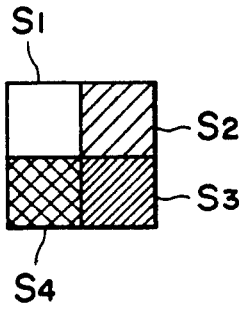
Figure 2A:
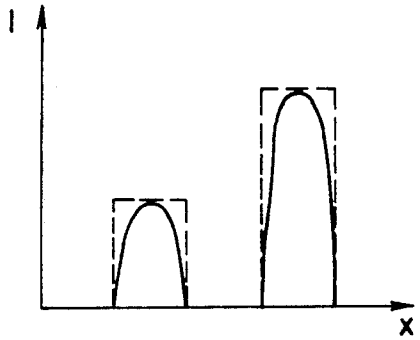
FIGS. 2A and 2B and FIGS. 3A and 3B show characteristic graphs showing exposure intensity distributions and potential distributions of electrostatic latent images for three-valued recording.
Figure 2B:
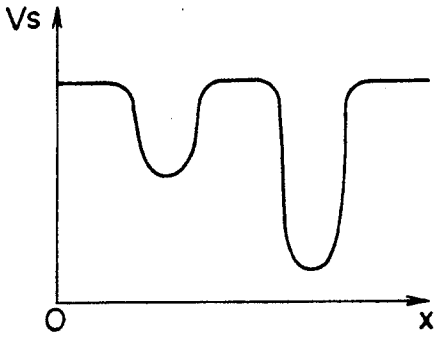
Figure 3A:
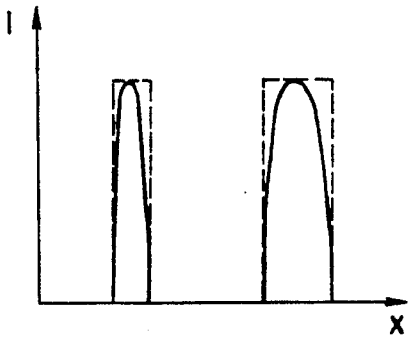
Figure 3B:
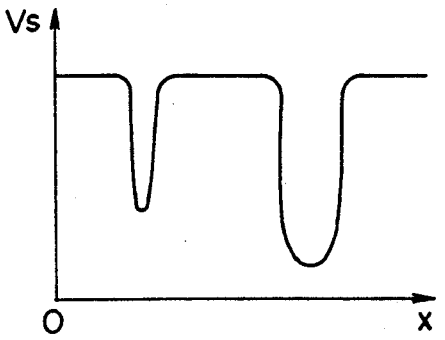

The concept of dizza matrix in the aforementioned multiple-valued dizza method is explained with reference to FIGS. 1A and 1B. FIG. 1A shows a three-valued dizza matrix of $2\times2$ arrangement, wherein regions $S_1$, $S_2$ and $S_3$ indicate three density level of white, gray and black, respectively. FIG. 1B shows a four-valued dizza matrix wherein regions $S_1$, $S_2$, $S_3$ and $S_4$ indicate 4 density levels of white, light grey, dark grey and black, respectively. The dot size corresponds to, e.g., 16 dots/mm. FIG. 2A and FIG. 3A show examples of exposure light intensity distributions for effecting three-valued recording in a light-scanning type electrophotographic priter, and FIGS. 2B and 3B show corresponding potential distributions of electrostatic latent images. The broken lines in FIGS. 2A and 3A represent output signals for generating a light beam for forming multiple-valued latent images. FIG. 2A shows output signals for providing a grey level (hereinafter referred to as "M level") corresponding to $S_2$ and a black level (hereinafter referred to as "H level") corresponding to $S_3$ respectively in FIG. 1A used in intensity modulation for controlling laser output. FIG. 3A shows output signals for providing M and H levels used in pulse duration modualtion for controlling laser output time. This is accomplished, for example, by setting the pulse duration for the M level to one half of that for the H level. The potential distributions of latent images obtained by light beams having exposure intensity distributions shown in FIGS. 2A and 3A are as shown in FIGS. 3A and 3B, respectively, wherein the latent image contrast of the M level obtained by pulse duration modulation tends to be smaller than that of the H level. As a result, the image density obtained after developing the M level becomes grey which is substantially the same as that after development of the M level shown in FIG. 2B obtained by the intensity modulation.

Figure 4:
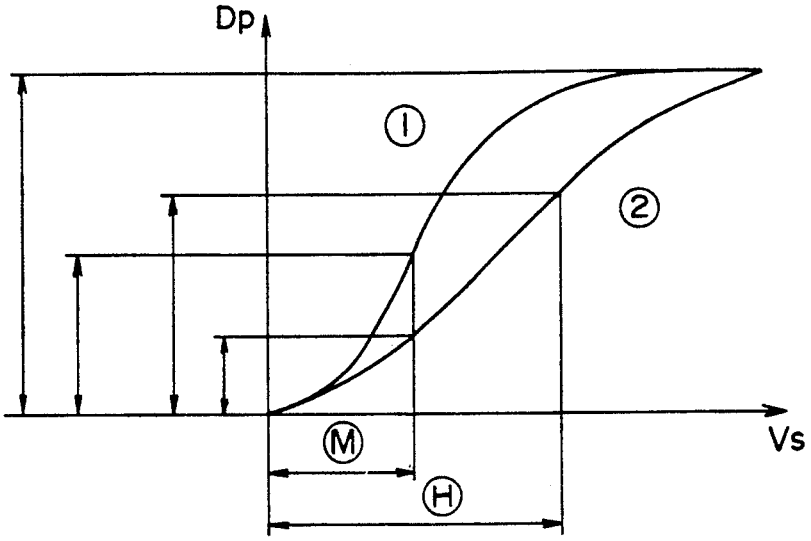
FIG. 4 shows a graph showing developing characteristics of multiple-valued latent images.

FIG. 4 shows a developing characteristic (Vs−Dp characteristic) in a case where multiple-valued images are developed. As will be understood from FIG. 4, in order to reproduce the latent images of M and H levels in FIGS. 2B and 3B (the respective potential contrasts (i.e., potential differences from the ground level) are represented by Ⓜ and Ⓗ in FIG. 4), a Vs−Dp characteristic (solid line ① in FIG. 4) having a relatively large $\gamma$(gamma; i.e., a slope of an image density vs. latent image potential curve) is required, especially when a sufficiently large H level contrast is not available. However, most of the conventional toners or developers used for developing analog latent images tend to show a developing characteristic as represented by solid line ② in FIG. 4 and have caused various problems. Thus, in order to develop a latent image composed of assembly of digital dots arranged in different densities, it is necessary to control the Vs−Vp characteristic more accurately than required for the development of conventional analog images. One requirement for developing digital images is to realize a large slope of Vs−Dp curve ($\gamma$), and another is to control the slope so as not to cause fluctuation thereof. Irregularity of charges imparted to toner particles provides an obstacle to realization of a large slope of Vs−Dp curve and is liable to cause fluctuation thereof. A Vs−Dp curve having a small slope fails to reproduce H level dots in a high density. Further such a Vs−Dp curve also fails to fully reproduce a density difference between the H and M levels or causes a problem that peripheries of dots cannot be clearly reproduced in a resultant image because the peripheries of the latent image dots have a lower potential than the centers thereof. For these reasons, there result in poor images with low image densities, poor sharpness and/or low resolutions. The irregularity of charges of toner particles causes fluctuation or variation of the Vs−Dp curve when a copying operation is continued for a large number of sheets or when the environmental conditions are changed and leads to the above described problems to a noticeable extent.

With the above factors in view, the toner according to the present invention has an improved charging characteristic by containing a specific positively chargeable compound.

The positively chargeable compound used in the invention may be a compound which is soluble in an organic solvent except for quaternary ammonium salts and pyridinium salts and has an oxidation potential relative to a saturated calomel electrode of 750 mV or below. The positively chargeable compound according to the invention should be soluble in an organic solvent in such a proportion as to allow the oxidation potential thereof. A compound having a solubility of 1 mmol or more in 1 liter of an organic solvent may preferably be used also in view of a good compatibility with the binder resin. The compound having a low oxidation potential has a property of readily evolving electrons spontaneously to be positively charged and, when contained in a toner for developing electrostatic images, can be a good charge controller which can provide individual toner particles with sufficient and uniform triboelectric charge.

A critical factor in the present invention is to provide a sufficient triboelectric charge evenly to individual toner particles. If it is only required to provide a sufficient charge to a toner, a compound having an oxidation potential of the order of 800 mV is sufficient as hereinafter described in examples. However, when such a compound is dispersed in individual toner particles with even a slight fluctuation, the fluctuation in dispersion will directly lead to a fluctuation in triboelectric charges provided to individual toner particles, whereby the imaging characteristics, particularly the Vs−Dp characteristic, are influenced thereby. In contrast thereto, a compound having an oxidation potential of 750 mV or below, particularly 700 mV or below, has a sufficiently high triboelectric chargeability for itself, so that it is hardly liable to provide such a fluctuation in triboelectric charge to individual toner particles as to influence the imaging characteristic of the toner, even if it is dispersed in individual toner particles with some fluctuation.

The oxidation potential values referred to in the present invention are based on a measurement wherein platinum electrodes were used as the sample and counter electrodes, a saturated calomel electrode was used as the reference electrode, and 0.1N-n-tetrabutylammonium perchloride was used as a supporting electrolyte. The measured values described herein were obtained by dissolving a sample compound at a concentration of 10–100 mmol/l solvent at a temperature of about 25° C. Another measurement method may be adopted while referring to the method used for the present invention. The solvent to be used may basically be selected from benzene, chloroform, methylene chloride, ethyl acetate, methanol and ethanol. If a compound is not soluble in the above group of solvents, another solvent capable of dissolving the compound may be selected case by case. In this case, the oxidation potential of the objective compound may be judged as to whether it is within the range of the invention by referring to the oxidation potential of a positively chargeable compound which is soluble in both the selected solvent and a solvent within the above group.

Figure 5A:
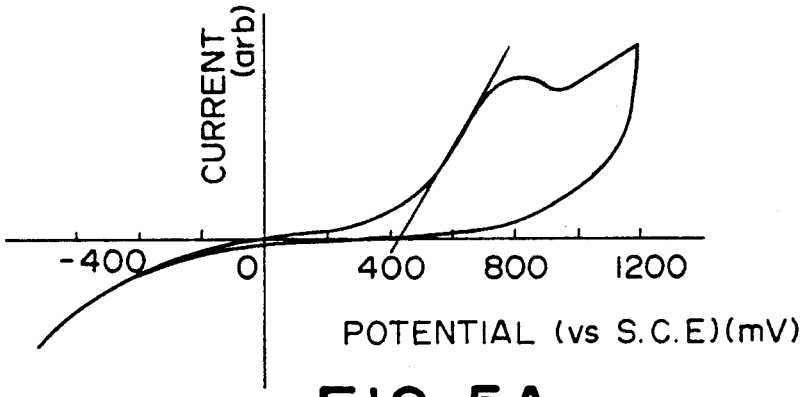
FIGS. 5A and 5B show potential-current curves relating to oxidation potentials of examples of the positively chargeable compound according to the invention.
Figure 5B:
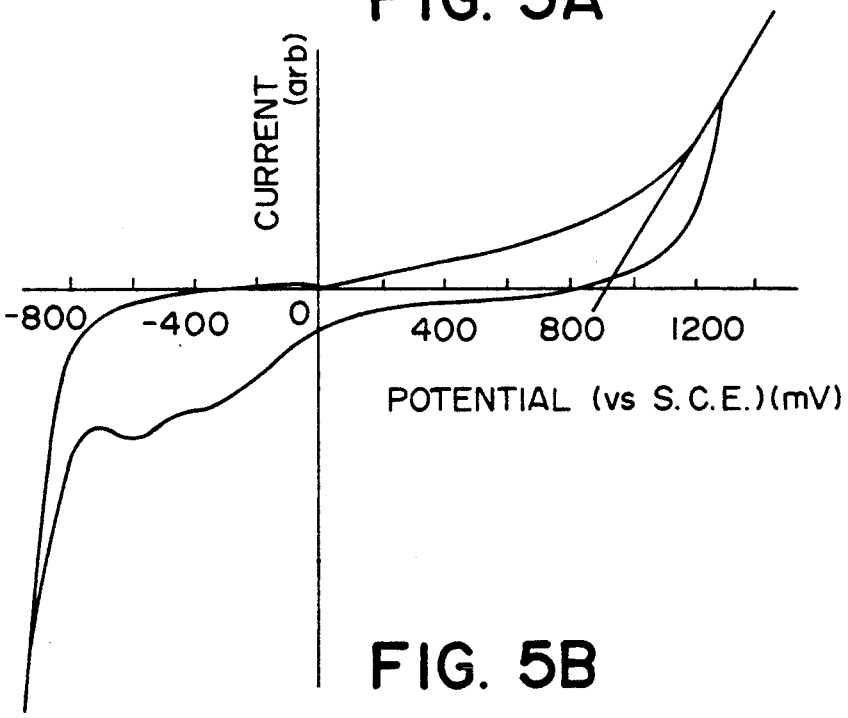
Figure 6:
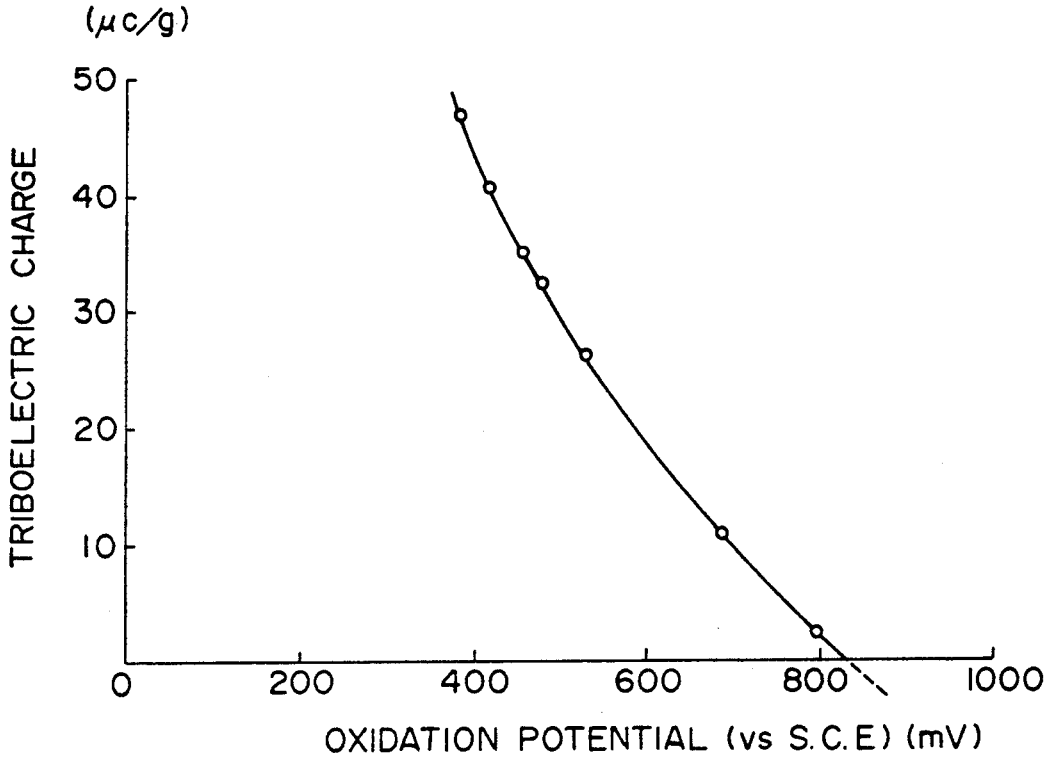
FIG. 6 shows an oxidation potential-toner triboelectric charge curve for a positively chargeable compound according to the invention.

FIG. 5A shows a potential-current curve for di(o-isopropylphenyl)guanidine, and FIG. 5B shows a potential-current curve for diphenylguanidine. In the present invention, an oxidation potential is determined by the intersection of an extension line of an oxidation peak and the abscissa. The result was obtained by using methylene chloride as the solvent. FIG. 6 shows a relationship between oxidation potentials and triboelectric charge of toner equivalents (respectively composed of 100 wt. parts of a styreneacrylic resin and 2 wt. parts of a positively chargeable compound providing the oxidation potentials) measured by the blow-off method as explained hereinbelow. A clear correlation was found between these values, showing that a toner containing a lower oxidation potential has a larger triboelectric charge.

In the above, the triboelectric charges were measured as follows. A sample toner was mixed with iron powder carrier with 200/300 mesh size in a proportion of 10:90. The mixture was accurately weighed in the range of 0.5 to 1.5 g, placed on a 400-mesh metal screen connected to an electrometer and subjected to suction by a pressure of 25 cm $H_2O$, whereby the triboelectric charge of a unit amount of the sample toner was calculated by the amount of the toner separated by the suction and the charge possessed thereby.

As described above, a compound having an oxidation potential of 750 mV or below, preferably 700 mV or below, is used in the present invention.

In the present invention, the positively chargeable compound is used in the form of fine particles. More specifically, the compound should have an average particle size of 5 microns or less, preferably 3 microns or less. Furthermore preferably, the compound should be in the form of particles in which 40% by number or more, particularly 50% by number or more, comprises particles having sizes which are 1/5 or less of the average particle size of the toner in order to provide uniform charge to the toner. When the average diameter is larger than 5 microns, the chargeability of the compound is not fully exhibited and a desirable Vs−Dp characteristic cannot be obtained for most cases. This is supported by the following observation of ours.

Figure 7:
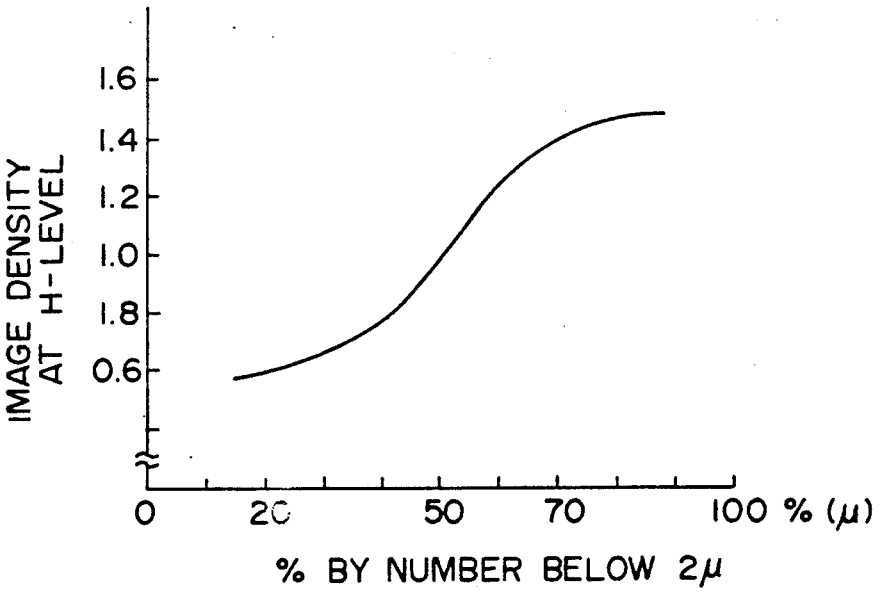
FIG. 7 shows a particle size-image density curve for a positively chargeable compound according to the invention.

When a substituted guanidine compound used as a charge controller in Example 1 which will be described separately hereinafter was pulverized and classified, as desired, to prepare samples having various average diameters. These samples were respectively formulated into sample toners respectively having the same composition as in Example 1 and having a size of 10 microns, which were then applied to a laser copier (Trade name: NP-9030, mfd. by Canon K. K.) using an amorphous silicon photosensitive member to carry out imaging. A substantial difference was not observed at the initial stage, whereas a decrease in image density was observed with respect to an image obtained at H level after the copying of several hundred to 1000 sheets in a case where a toner containing the charge controller having an average particle size larger than 5 microns and containing less than 30% by number of particles having sizes of 2 microns smaller was used. A relationship between the average particle size and the density of images obtained at H level at the time of 500 copies is shown in FIG. 7. We presume that this is because the particle size of the charge controller compound according to the present invention is closely related with the probability of presence of the compound at the toner surfaces so that finer sizes of the compound are present at the surface in a larger probability to exhibit its potential ability more efficiently. If the compound is not in the form of particles having desired particle sizes, it is preferred to use the compound after pulverizing it by means of a micropulverizer such as a jet mill.

The particle sizes of the compound and the toner as described above and used in the specification are based on the values measured by a Coulter Counter type II and calculated on the basis of number of particles. Thus, the term "average particle size" is used to denote "number-average particle size". Herein, the aperture size and method of dispersing samples may be appropriately selected depending on the objective sample compound. As for a toner having a size of the order of 10 microns, for example, an aperture size of 100 microns may be adopted, and the toner may be subjected to measurement after dispersing it in a concentration of 5–20% and subjecting the dispersion to ultrasonic dispersion for about 5 minutes. For a compound having a size of the order of several microns, an aperture of 30 microns may be adopted for a dispersion in a concentration of 10 to 20% after ultrasonic dispersion for about 15 minutes.

The charge controller compound according to the present invention has such a whiteness (W) as can be regarded as substantially colorless or white.

According to out knowledge about the relationship between the triboelectricity and the color of a compound, most compounds having a large triboelectric chargeability or a low oxidation potential generally have a dense color and cannot be used to provide a clear color toner.

Triboelectric charging process of a solid material is broadly divided into a contact stage and a separation stage. The contact stage is a stage wherein an electric double layer is formed between materials and exchange of charges occurs. The polarity of a resultant charge is determined in this stage. The separation stage is a stage wherein materials contacting each other are separated form each other and leakage of charge occurs. The amount of triboelectric charge, when considered with a major attention to the contact stage, depends on how readily the materials concerned exchange charges and how many contact points the materials have. The latter mentioned number of contact points depends on the aforementioned particle size of the material or compound, while the formerly mentioned readiness of charge exchange is related with the color of the material or compound in many cases.

Thus, in order for a material to be positively charged, the material is required to absorb energy in some form and evolve electrons. Accordingly, a material to be charged positively should desirably evolve electrons at a low energy and stably retain the state thereafter. When these properties are considered in connection with the structure of a compound, the evolution of electrons at a low energy requires a small band gap (or work function) and the stable retention of the state after electron evolution requires unlocalization of locally generated charge after the electron evolution. Most compounds which have been used as charge controllers, particularly positive charge controllers, have conjugated a double bond in order to satisfy the above conditions. As a result, most charge controller compounds are in dense colors and very few are in light colors.

As a result of energetic study, we have found that there are some compounds which can stabilize locally generated charge even without such a degree of conjugated double bond as to provide a dense color and they are free of dense colors.

The positively chargeable compound according to the present invention should preferably have a whiteness as defined in the following equation (described in, e.g., "Shikisai Kagaku (Color Science) Handbook" page 237, right column, line 7, published from Kabushiki Kaisha Nankodo):

$$W=1-1/40\{C^2+[4(10-V)]^2\}^{\frac{1}{2}}$$

wherein C and V are chroma and value, respectively, in the characterization system according to JIS Z8721 using three attributes of colors.

The chroma (C) and value (V) of the positively chargeable compound according to the present invention may be obtained in the following manner. A small amount of a sample compound is taken in a transparent bag is compared with glossy type standard color chips according to JIS Z8721 (available from Japanese Standards Institute) according to a surface color comparison method prescribed by JIS Z8723 to determine the chroma (C), value (V) and, if desired, hue (H). Herein, it is preferable to use a mask and place the standard color chips in a plastic bag which is the same as the one containing the sample compound in order to increase the accuracy of the measurement.

The hue of the toner is affected not only by the whiteness of the compound according to the present invention but also by the amount of addition thereof when it is added in a large quantity.

The above compound may be added to the toner internally (incorporated inside the toner) or externally as by dry mixing. In the case of the internal addition, the amount of the compound to be added may depend on several factors involved in a toner production process including kind of binder resin, optionally used additive and method of dispersion and are not determined in a single way. However, when other performances are also taken into consideration, the compound should preferably be used in a proportion of 0.1 to 20 wt. parts, more preferably 0.5 to 10 wt. parts, per 100 wt. parts of the binder resin.

In the case of the external addition, the compound should preferably be used in a proportion of 0.01 to 10 wt. parts per 100 wt. parts of the binder resin.

For complying with the addition quantity range as described above, the compound should have a whiteness (W) of 0.5 or more and more preferably satisfy a combination of a chroma (C) of 10 or less and a whiteness (W) of 0.55 or larger, particularly 0.6 or larger. When such a combination is given, the addition of the compound would not provide an undesirable effect to the color of the toner.

As described above, the charge controller used in the present invention is a positively chargeable compound satisfying the conditions of (1) an oxidation potential of 750 mV or below, (2) an average particle size of 5 microns or smaller, and a whiteness W of 0.5 or above, in combination.

Such compounds satisfying the above mentioned conditions may be found in the classes of (1) nitrogen-containing organic compounds, (2) phosphorus-containing organic compounds, (3) metal complexes and (4) organic metal compounds. More specifically, the nitrogen-containing organic compounds include compounds having one or more amino groups substituted with an aryl group and having 14 or more carbon atoms. Examples thereof include nitrogen-containing organic compounds such as substituted granidine compounds or substituted triazine compounds.

The phorphous-containing organic compounds include compounds having one or more phosphino groups substituted with an aryl group and having 14 or more carbon atoms. Example of the phosphorus-containing organic compounds include those represented by the formula:

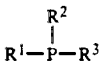

wherein $R^1$, $R^2$ and $R^3$ are the same or different groups including aryl and alkaryls.

The metal complexes include those having a compound containing at least one amino group as a ligand and having 14 or more carbon atoms. Examples thereof include metal complexes having an aromatic compound having two amino groups as a ligand or metal complexes having an aromatic compound having an amino group and a hydroxyl group as a ligand.

The organic metal compounds include metal compounds having a directly connected aryl group and having 18 or more carbon atoms. Examples thereof include bismuth or antimony compounds having an aryl group.

For example, the nitrogen-containing compounds include the substituted guanidine compounds represented by the following formula, from which those satisfying the prescribed oxidation potential and whiteness may be selected according to the present invention:

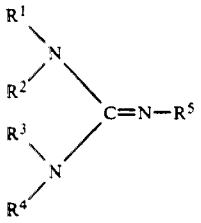

wherein $R^1$, $R^2$, $R^3$, and $R^4$ and $R^5$ are the same or different groups including hydrogen atom, alkyl, cyaloalkyl, alkenyl, aryl, aralkyl, alkaryl, and heterocyclic groups, of which a hydrogen atom may be replaced by a substituent group, and at least one of $R^1$, $R^2$, $R^3$, $R^4$ and $R^5$ is a group other than hydrogen.

Specific examples of the substituted quanidine compounds include the following:

(1)

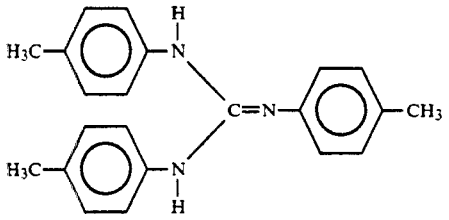

-continued (2)

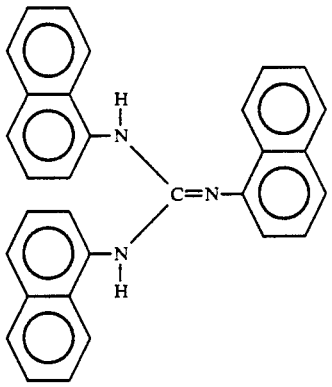

(3)

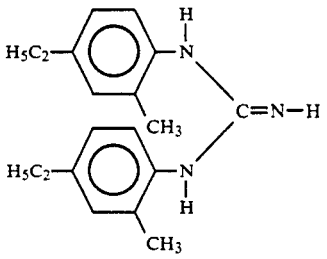

(4)

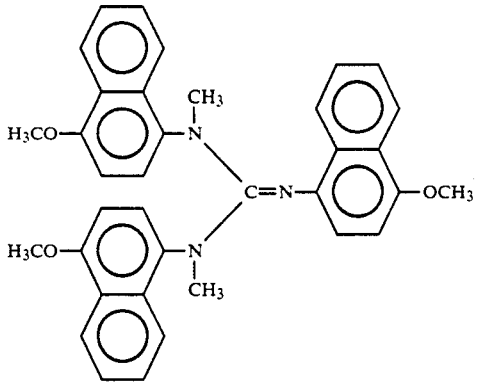

(5)

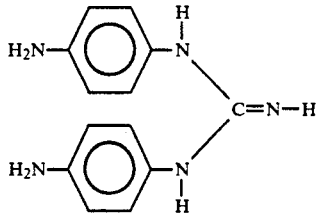

(6)

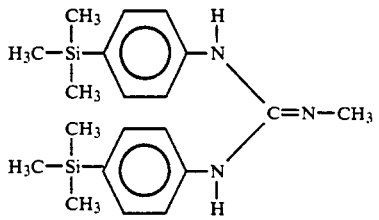

-continued (7)

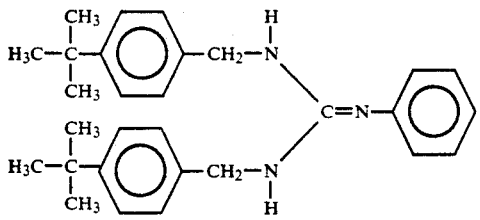

(8)

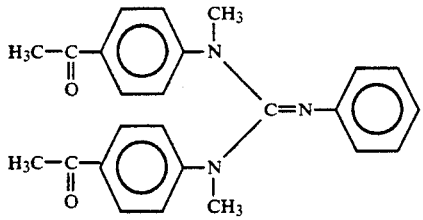

(9)

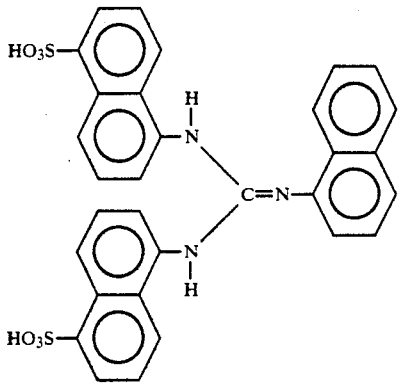

A conventional charge controller may be used in combination with the charge controller compound according to the invention as far as it does not provide a harmful effect to the toner according to the invention. In this case, however, the conventional charge controller should be used in a smaller quantity than that of the compound according to the present invention in order to provide a better result.

The charge controller compound according to the present invention may of course be used in combination with a colorant to form a toner of a desired color. In this case, as the compound according to the invention has a high degree of whiteness, it accentuate the color of a colorant used in combination and also can reduce the amount of the colorant.

The colorant to be used in the present invention may be one or a mixture of known dyes or pigments including Carbon Black, Lamp Black, Iron Black, ultramarine blue, Aniline Blue, Phthalocyanine Blue, Phthalocyanine Green, Hansa Yellow G, Rhodamine 6G Lake, Chalcooil Blue, Chrome Yellow, Quinacridone, Benzidine Yellow, Rose Bengal, triarylmethane dyes, monoazo and disazo dyes.

The binder resin for the toner of the present invention may be composed of homopolymers of styrene and derivatives thereof such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and styrene-dimethylaminoethyl methacrylate copolymer; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resin, rosin, modified rosins, terpene resin, phenolic resins, aliphatic or alicyclic hydrocarbon resins, aromatic petroleum resin, chlorinated paraffin, paraffin wax, etc. These binder resins may be used either singly or as a mixture.

The following binder resins may suitably be used singly or as a mixture, in particular, for providing a pressure-fixable toner:

Polyolefins such as low molecular-weight polyethylene, low molecular-weight polypropylene, polyethylene oxide and poly-4-fluoroethylene waxes such as polyethylene wax and paraffin wax; epoxy resin, polyester resin, styrene-butadiene copolymer (monomer ratio 5–30:95–70), olefin copolymers such as ethylene-acrylic acid copolymer, ethylene-acrylate copolymers, ethylene-methacrylic acid copolymer, ethylene methacrylate copolymers, ethylene-vinyl chloride copolymer, ethylene-vinyl acetate copolymers and ionomer resins); polyvinyl pyrrolidone, methyl vinyl ether-maleic anhydride copolymer, maleic acid-modified phenolic resin, and phenol-modified terpene resin.

The toner according to the present invention may be mixed with carrier particles to form a two-component developer. The carrier particles to be used for this purpose may be those known in the art including, for example, powder or particles of metals such as iron, nickel, aluminum and copper, alloys of these metals or metal compounds including oxides of these metals; and powder or particles of ceramics such as glass, SiC, $BaTiO_2$ and $SrTiO_2$. These particles may be coated with a resin, etc. Alaternatively, resin particles or resin particles containing a magnetic material may also be used.

The toner according to the invention may be composed as a magnetic toner by incorporating therein a magnetic material. The magnetic material to be used for this purpose may be one or a mixture of: iron oxides such as magnetite, hematite and ferrite; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These magnetic materials may preferably be in the form of particles having an average particle size of the order of 0.1 to 2 microns and be used in the toner in an amount of about 20–200 wt. parts, particularly 40–150 wt. parts, per 100 wt. parts of the resin component.

Another optional additive may be added externally or internally to the toner so that the toner will exhibit further better performances. Optional additives to be used as such include, for example, lubricants such as teflon and zinc stearate; abrasives such as cerium oxide and silicon carbide; flowability improvers such as colloidal silica and aluminum oxide; anti-caking agent;

conductivity-imparting agents such as carbon black and tin oxide; or fixing aids such as low molecular-weight polyethylene.

These additives may preferably have the same triboelectric polarity as the toner or have almost no triboelectric chargeability in order to have the toner fully exhibit its effect.

The toner for developing electrostatic images according to the present invention may be produced by sufficiently mixing the charge controller compound according to the invention with a vinyl on non-vinyl thermoplastic resin such as those enumerated hereinbefore, a pigment or dye as a colorant and, optionally, a magnetic material, an additive, etc., by means of a mixer such as a ball mill, etc.; then melting and kneading the mixture by hot kneading means such as hot rollers, kneader and extruder to disperse or dissolve the pigment or dye, the charge controller and optional additives, if any, in the melted resin; cooling and crushing the mixture; and subjecting the powder product to classification to form toner particles having an average particle size of 5 to 20 microns.

Alternatively, another method may be used such as a method of dispersing in a solution of the binder resin the other prescribed components and spray-drying the dispersion; a method of mixing in a monomer providing the binder resin the other prescribed ingredients to form a suspension and polymerizing the suspension to obtain a toner; or a method providing a capsule toner comprising a core and a shell.

The thus obtained toner according to the present invention may be used in known manners for developing electrostatic latent images obtained by electrophotography, electrostatic recording, electrostatic printing, etc., to visualize the latent images.

Hereinabove, the toner according to the present invention which is a typical and most preferred embodiment of the triboelectrically chargeable composition according to the present invention, has been fully described with respect to its ingredients, production process and use thereof. However, the triboelectrically chargeable composition according to the present invention may also be embodied as a charge-imparting material (or member) or toner movement-regulation material inclusive of magnetic particles, a carrier, a doctor blade, a toner-carrying member such as a sleeve by utilizing an excellent positive chargeability of the charge controller compound according to the invention. The charge-imparting material may be defined as a solid material which imparts or supplements a charge necessary for development to a toner while contacting the toner prior to or during the developing step.

In order to provide the charge-imparting material according to the invention, the charge controller compound according to the invention may be applied as a coating on or dispersed or incorporated in a base material which may be in the form of carrier particles or a fixed member such as a doctor blade or sleeve.

For this purpose, the positively chargeable charge controller compound according to the invention may be used as such in the form of particles, or dispersed in a solvent or dispersant, or otherwise dispersed in a resin or a solution thereof. In the dispersion, powder of a ceramic material such as silica, aluminum oxide, cerium oxide or silicon carbide may be added as a filler. Further, a conductivity imparting agent such as carbon black or tin oxide may be added to control the conductivity. In order to avoid the deposition or accumulation of spent toner on the sleeve or carrier particles as embodiments of the charge-imparting material, a releasing agent such as an aliphatic acid metal salt or polyvinylidene fluoride may be added.

As the resin for carrying or dispersing the charge controller compound according to the present invention may be those generally used including polystyrene, polyacrylic acid esters, polymethacrylic acid esters, polyacrylonitrile, rubber resins such as polyisoprene and polybutadiene, polyester, polyurethane, polyamide, epoxy resin, rosin, polycarbonate, phenolic resin, chlorinated paraffin, polyethylene, polypropylene, silicone resin, teflon, etc. Derivatives of these resins, copolymers of constituted monomers of these resins and mixtures of these resins may also be used.

The coating amount or content of the charge controller compound on the surface or in the surface layer of the charge-imparting material for development of electrostatic images which may be carrier particles, magnetic particles a sleeve or a doctor blade, should be appropriately controlled and preferably be 0.01–10 mg/cm$^2$, particularly 0.01–2 mg/cm$^2$.

The carrier particles as an embodiment of the charge-imparting material, particularly the base material thereof, may be those as described above to be combined with the toner according to the invention.

The sleeve as another embodiment of the charge-imparting material may be formed of, for example, metals such as iron, aluminum, stainless steel and nickel or alloys of these metals. Further, the sleeve may be formed of a non-metallic substance such as ceramics and plastics.

In order to produce the charge-imparting material, for example, the carrier particles may be obtained by dipping the base or core particles in a dispersion of the charge-imparting compound in a resin solution or dispersion or applying the dispersion to the base particles, and thereafter drying the coated particles, as desired.

The sleeve may be obtained by applying the dispersion of the charge-imparting compound as described above by dipping, spraying, brush coating.

Alternatively, the charge-imparting compound according to the invention may be dispersed in a shapable resin to form carrier particles, a sleeve or a doctor blade.

The present invention will be more specifically explained with reference to examples, while it is to be understood that the present invention is not limited to the specifically described examples. In the examples, "parts" used for describing formulations are all by weights.

EXAMPLE 1

| | |
|---|---|
| Styrene/butyl acrylate (weight ratio = 80:20) copolymer (weight average molecular weight $\overline{Mw}$: about 300,000) | 100 parts |
| Carbon black (Mitsubishi #44) | 10 parts |
| Low-molecular weight polyethylene wax | 2 parts |
| Tri-p-tolylguanidine [Substituted guanidine compound of example (1)] | 7 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with a number average particle size of 10 microns.

The above fine powder as a toner in an amount of 5 parts was mixed with 100 parts of iron powder carrier with an average particle size of 50-80 microns to prepare a developer.

The tri-p-tolyl guanidine was obtained through pulverization by means of a micropulverizer and classification and was a nitrogen-containing compound having an oxidation potential of 530 mV as measured in methylene chloride as the solvent, a whiteness of 0.9 and an average particle size of 2.5 microns with 60% or more by number of the particles having sizes of 2 microns or below.

Figure 8:
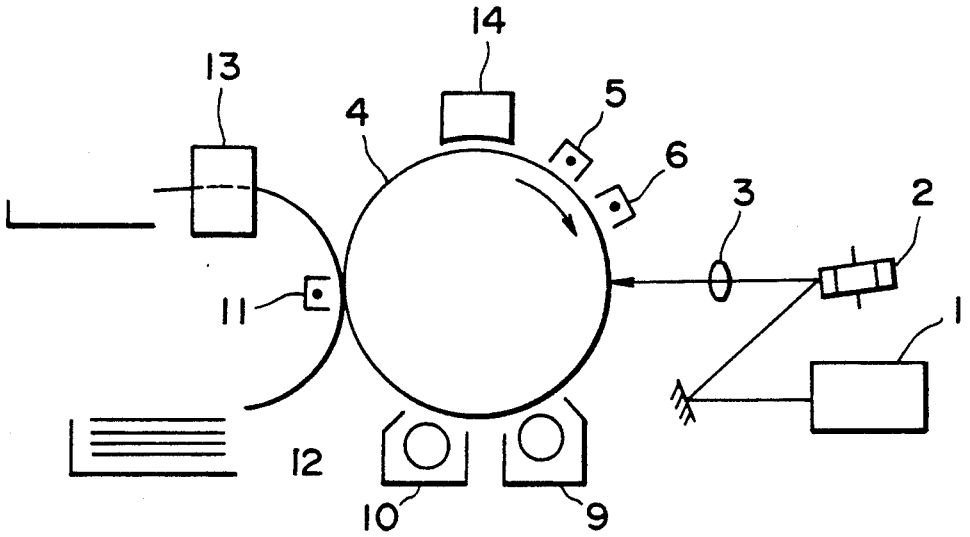
FIG. 8 illustrates an embodiment of an electrophotographic printer to which the toner according to the invention is applied.

In FIG. 8 is shown a electrophotographic printer to which the present invention is applicable and which was used in this Example. An electric signal was put into a laser modulating unit 1 and put out as a modulated laser beam, which was then passed through a scanner mirror 2 and an f-$\theta$ lens 3 to scan a photosensitive drum 4 along the lengthwise direction thereof. The photosensitive drum 4 was rotated in the direction of an arrow whereby the laser beam could be irradiated to scan the drum two-dimensionally.

The photosensitive drum 4 may comprise a photosensitive material such as amorphous silicon, selenium, CdS or an organic conductor, which has been sensitized to have a sensitivity in the wavelength range of, e.g., a semiconductor laser beam (780-800 nm). In this example, an amorphous silicon photoconductor was used to form the photosensitive drum 4. The surface potential of the photosensitive drum 4 was smoothed by an AC charge remover 5, and then the drum 4 was charged to 380 V by a charger 6. Thereafter, the drum 4 was subjected to laser beam exposure by image-scanning scheme to form thereon dot latent images by a three-valued dizza method. M level among the three values or levels was provided by pulse duration modulation of the laser beam as shown in FIG. 3A. The latent image potentials were 250 V for H level and 120 V for M level.

The thus obtained dot latent images were reversely developed with the above mentioned developer containing the toner contained in a developer 9 or 10 under the application of a DC bias of 280 V.

Figure 9:
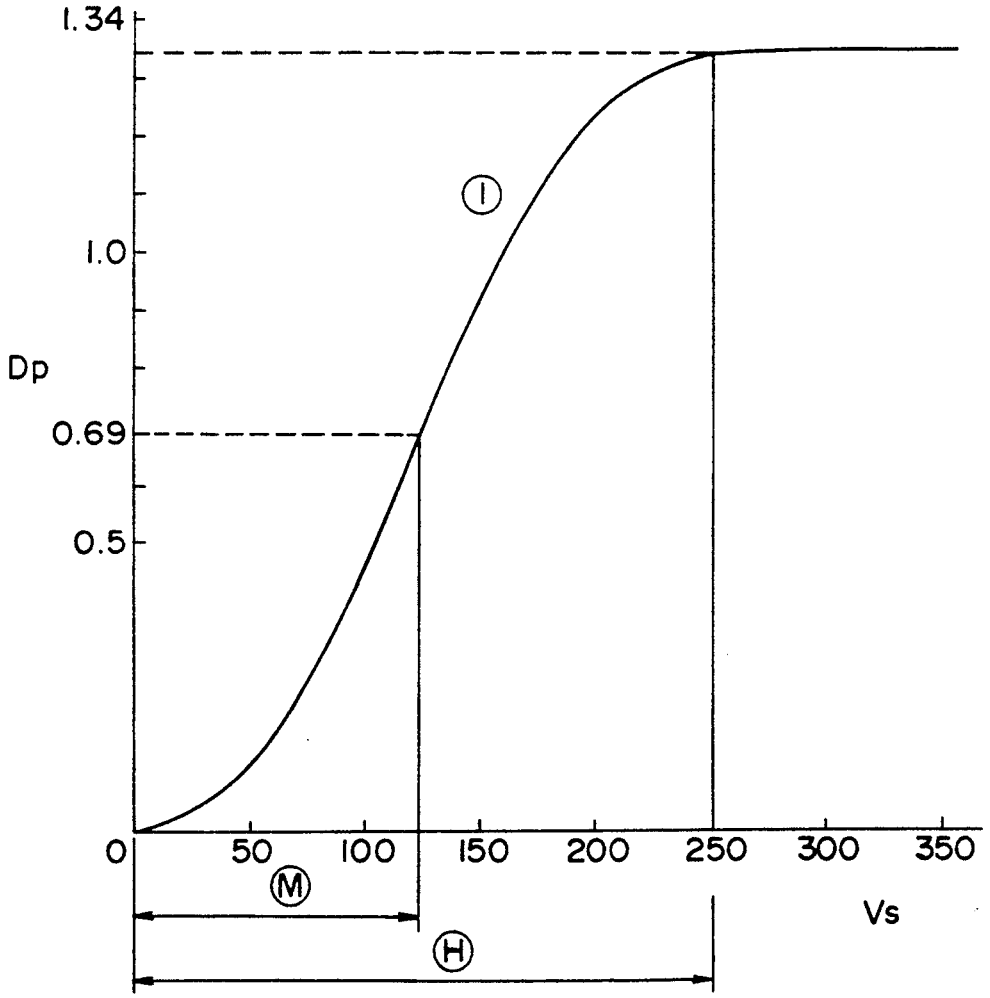
FIG. 9 shows a graph showing a developer characteristic of an example of the toner according to the invention.

The thus developed toner image was then transferred onto a transfer paper 12 by means of a transfer charger 11 and fixed onto the transfer paper 12 by means of a fixer 13. The toner remaining on the photosensitive drum without transfer was collected by a cleaner 14. The image formed on the transfer paper showed image densities of 1.34 corresponding to H level and 0.69 for M level, thus providing a sufficiently high image density at a solid image portion, with sharp separation between dots and could beautifully reproduce a photographic image which can be a good measure for evaluation of capability of reproducing a half tone. The Vs−Dp characteristic obtained at this stage is shown in FIG. 9. When 10000 sheets of continuous copying was conducted, the fluction in image density for H level was within ±0.07 and within ±0.15 for M level, so that a remarkable variation was not observed in the Vs−Dp characteristic. Further, when the environmental conditions were changed to 35° C. and 80%, and 15° C. and 10%, respectively, good images were obtained as under the normal temperature and normal humidity conditions, and the performances did not change remarkably during a successive copying operation of 10,000 sheets.

This developer did not cause a remarkable change in performances from the initial ones even after a storage for a half year.

EXAMPLE 2

A toner was obtained in the same manner as in Example 1 except that 7 parts of tri-p-tolyl-guanidine was replaced by 5 parts of 1,8-diaminonaphthalene-Co complex and the obtained toner was used in the same manner to form an image. The resultant image showed an image density of 1.32 for H level and 0.65 for M level, a sufficiently high image density for a solid image portion, and sharp separation between dots and could beautifully reproduce a photographic image as a measure for half tones.

When 10,000 sheets of continuous copying was conducted, the density fluctuation was within ±0.07 for H level and ±0.15 for M level, so that a substantial variation in the Vs−Dp characteristic was not observed. Further, when the environmental conditions were changed to 35° C.-80% and 15° C.-10%, good images were also obtained in respective cases similarly as under the normal temperature-normal humidity conditions, and the performances did not change remarkably during a successive copying operation of 10,000 sheets.

The 1,8-diaminonaphthalene-Co complex used was obtained through micro-pulverization and showed an oxidation potential of 420 mV, a whiteness of 0.6 and an average particle size of 2.1 microns including 60% or more by number of the particles having sizes of 2 microns or smaller.

COMPARATIVE EXAMPLE 1

A toner was obtained and used for imaging in the same manner as in Example 1 except that 7 parts of tri-p-tolylguanidine was replaced by 7 parts of cerium acetate.

The resultant image showed an optical density of 0.3 for H level and 0.21 for M level and was difficult for practical use.

The cerium acetate used was a metal salt showing an oxidation potential of 850 mV, a whiteness of 0.9 and an average particle size of 2.9 microns including 70% or more by number of the particles having sizes of 2 microns or smaller.

EXAMPLE 3

| | |
|---|---|
| Styrene/butyl acrylate (weight ratio = 80:20) copolymer (weight average molecular weight $\overline{Mw}$: about 300,000) | 100 parts |
| Magnetite EPT-5000 (produced by Toda Kogyo K.K.) | 60 parts |
| Low-molecular weight polypropylene wax | 2 parts |
| N,N',N''-trinaphthylguanidine [Substituted guanidine compound of example (2)] | 3 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification by use of a wind force classifier to obtain fine powder with a number average particle size of 10 microns. Then, 0.4 part of hydrophobic colloidal silica treated with amino-silicone oil (produced by Nihon Aerosil K. K.) was admixed with 100 parts of the fine powder as obtained above to prepare a one-component magnetic toner.

The toner was applied to a commercially available laser copier (Trade name: NP-9030 mfd. by Canon K. K.) for imaging.

The resultant image showed an image density of 1.41 for H level and 0.65 for M level, a sufficiently high image density for solid portion, and sharp separation between dots and could beautifully reproduce a photographic image as a measure for half tones.

When 10,000 sheets of continuous copying was conducted, the density fluctuation was within ±0.07 for H level and ±0.15 for M level, so that a substantial variation in the Vs−Dp characteristic was not observed. Further, when the environmental conditions were changed to 35° C.-80% and 15° C.-10%, good images were also obtained in respective cases similarly as under the normal temperature-normal humidity conditions, and the performances did not change remarkably during a successive copying operation of 10,000 sheets.

The N,N',N''-trinaphthylguanidine used was obtained through micro-pulverization and showed an oxidation potential of 350 mV, a whiteness of 0.9 and an average particle size of 2.4 microns including 70% or more by number of the particles having sizes of 2 microns or smaller.

EXAMPLE 4

A toner was obtained in the same manner as in Example 3 except that 3 parts of N,N',N''-trinaphthylguanidine was replaced by 5 parts of 4,4'-bis[2,4-dicumidino-1,3,5-triazinyl-6-amino]-diphenylmethane and the obtained toner was used in the same manner to form an image. The resultant image showed image density of 1.38 for H level and 0.60 for M level, a sufficiently high image density for solid portion, and sharp separation between dots and could beautifully reproduce a photograpic image as a measure for half tones.

When 10,000 sheets of continuous copying was conducted, the density fluctuation was within ±0.07 for H level and ±0.15 for M level, so that a substantial variation in the Vs−Dp characteristic was not observed. Further, when the environmental conditions were changed to 35° C.-80% and 15° C.-10%, good images were also obtained in respective cases similarly as under the normal temperature-normal humidity conditions, and the performances did not change remarkably during a successive copying operation of 10,000 sheets.

The 4,4'-bis[2,4-dicumidino-1,3,5-triazinyl-6-amino]-diphenylmethane used was obtained through micro-pulverization and was a nitrogen-containing organic compound showing an oxidation potential of 390 mV, a whiteness of 0.8 and an average particle size of 2.2 microns including 70% or more by number of the particles having sizes of 2 micron or smaller.

COMPARATIVE EXAMPLE 2

A toner was obtained and used for imaging in the same manner as in Example 3 except that 3 parts of N,N',N''-trinaphthylguanidine was replaced by 7 parts of di-o-tolylguanidine.

The resultant image showed an image density of 1.32 for H level and 0.61 for M level and was satisfactory at the initial stage, whereas the image density lowered as the copying operation was repeated to reach 0.63 for H level and 0.41 for M level after copying 500 sheets. The image obtained at this stage contained more fog than in Example 3 and was not practically acceptable.

Further, under the environmental conditions of 35° C. and 80%, the image density was 0.71 for H level and 0.38 for M level from the initial stage and the image was far from practically acceptable level. The di-o-tolylguanidine used was a nitrogen-containing organic compound showing an oxidation potential of 600 mV, a whiteness of 0.9 and an average particle size of 5.9 microns including less than 30% of the particles having sizes of 2 microns or smaller.

EXAMPLE 5

| | |
|---|---|
| Styrene/butyl acrylate (weight ratio = 80:20) copolymer (weight average molecular weight $\overline{Mw}$: about 300,000) | 100 parts |
| Copper phthalocyanine blue pigment | 5 parts |
| Low-molecular weight polypropylene wax | 2 parts |
| Tris(2,4,6-trimethylphenyl)bismuth | 7 parts |

The above ingredients were sufficiently blended in a blender and then kneaded on a twin roll heated to 150° C. The kneaded product was left to cool, coarsely crushed by a cutter mill, pulverized by means of a micropulverizer with a jet air stream and further subjected to classification bu use of a wind force classifier to obtain fine powder with particle sizes of 5-20 microns (average particle size: 12.5 microns).

Then, 50 parts of magnetic particles with particle size of 50-80 microns were mixed with the fine powder to form a developer.

The developer was applied to a commercially available copying machine (Trade name: PC-22 mfd. by Canon K. K.) for imaging.

As a result, clear blue image was obtained at an image density of 1.35 without fog and with satisfactory image sharpness. After 2000 sheets of repetitive coying operation, the image density was 1.33 with substantially no charge and no deterioration in sharpness of image was observed. Further the same copying operation was carried out under the environmental conditions of 35° C.-85% and 15° C.-10%, respectively, whereby good images were obtained in respective cases equally to those obtained under the normal temperature-normal humidity conditions.

The tris(2,4,6-trimethylphenyl)bismuth used was obtained through micro-pulverization and showed an oxidation potential of 680 mV, a whiteness of 0.9 and an average particle size of 3.0 microns including 50% or more by number of the particles having sizes of 2 microns or smaller.

COMPARATIVE EXAMPLE 3

A toner was obtained and used for imaging in the same manner as in Example 5 except that 7 parts of tris(2,4,6-trimethylphenyl)bismuth was replaced by 5 parts of 2-amino-5-methylphenol-Zn complex.

The resultant image showed a density of 1.30, which was acceptable, but was an image lacking clearness and presenting dark blue color because of the influence of the 2-amino-5-methylphenol-Zn complex.

The Zn complex used was a metal complex showing an oxidation potential of 520 mV, a whiteness of 0.4 and an average particle size of 6.3 microns.

EXAMPLE 6

A substituted guanidine (Compound example (1) described before) in an amount of 100 g was dissolved or dispersed in 1 liter of methyl ethyl ketone, in which was further added 1 kg of iron powder carrier (particle size: 250–400 mesh). The mixture was further stirred for about 30 minutes in a ball mill and the mixture, after removal of the solvent, was dried and crushed to disintegrate a slight agglomeration thereby to obtain a treated iron powder carrier improved in charge-imparting ability.

Separately, 100 parts of a styrene resin (Trade name: D-125, mfd. by Shell Chemical Co.) and 6 parts of carbon black (Trade name: Raven 3500, mfd. by Cabot Co.) were kneaded, crushed and classified to prepare a toner having sizes of 1–30 microns. This toner and the above mentioned treated iron powder carrier was mixed in a weight ratio of 10:100. The triboelectric charge of the thus obtained developer was measured by the blow off method to be $-11.5\ \mu C/g$.

The developer was used for imaging by means of a copying machine (NP-5000, mfd. by Canon K. K.). As a result, copied images were obtained with very little variation in image density, good reproducibility of thin line images and good gradation and without fog, even after 50000 sheets of successive copying test.

EXAMPLE 7

In 1 liter of xylene was dissolved 100 g of polymethyl methacrylate resin and further mixed 50 g of substituted guanidine (Compound example (2) as described before). Into the solution thus obtained was dipped a developing sleeve (made of stainless steel) for a copier (NP-400RE, Canon K. K.), and the solvent was removed to form a coating film at a rate of 0.1 to 0.6 mg/cm$^2$. The thus coated sleeve was affixed to a developing apparatus for the copier (NP-400RE) and was used for a test explained hereinafter.

Separately, the following ingredients were kneaded, crushed and classified to prepare a toner having particle sizes of 1 to 30 microns.

| | |
|---|---|
| Styrene/butyl methacrylate copolymer ($\overline{Mw}$ = 300,000) | 100 parts |
| Low-molecular weight polyethylene (Trade name: PE-130, mfd. by Hoechest A.G.) | 4 parts |
| Magnetite (Trade name: BL-200, mfd. by Titan Kogyo K.K.) | 60 parts |

The thus prepared toner was subjected to a successive imaging test by means of the above-mentioned developing apparatus provided with the coated sleeve. During 50,000 sheets of successive imaging, images were obtained without change from the initial stage, with good reproducibility of thin lines and good gradation and with substantially no fog.

The surface potential on the sleeve was measured to be $-34$ V, and the toner was confirmed to be completely negatively charged.

What is claimed is:

1. A positively chargeable toner for developing electrostatic images comprising binder, colorant, and particles of a positively chargeable compound selected from the group consisting of nitrogen-containing organic compounds having 14 or more carbon atoms and an aryl group, organic phosphino compounds having 14 or more carbon atoms and represented by the formula:

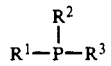

wherein $R^1$, $R^2$ and $R^3$ are independently aryl or alkaryl), organic metal complexes having 14 or more carbon atoms and at least one amino group as a ligand, and organic metal compounds having 18 or more carbon atoms and a directly connected aryl group, excepting for quaternary ammonium and pyridinium salts, wherein the positively chargeable compound is soluble in an organic solvent and has an oxidation potential of 750 mV or below, a whiteness W of 0.5 or above, and an average particle size of 5.0 microns or less, at least 50% by number of said particles being at most 1/5 of an average particle size of said toner.

2. The toner according to claim 1, wherein said positively chargeable compound has an oxidation potential of 700 mV or below.

3. The toner according to claim 1, which comprises 0.1 to 20 wt. parts of the positively chargeable compound contained in 100 wt. parts of the binder resin.

4. The toner according to claim 3, which comprises 0.5 to 10 wt. parts of the positively chargeable compound contained in 100 wt. parts of the binder resin.

5. The toner according to claim 1, wherein said positively chargeable compound is soluble in an organic solvent.

6. The toner according to claim 1, wherein said positively chargeable compound is soluble in an organic solvent in a concentration of 1 mmol/1-solvent or higher.

7. The toner according to claim 1, wherein said positively chargeable compound has a whiteness of 0.55 or above.

8. The toner according to claim 1, which has an average diameter of 5–20 microns.

9. An image forming method, comprising the steps of:

forming a digital electrostatic latent image on a latent image-bearing member, and developing the digital latent image with a positively chargeable toner for developing electrostatic images, the toner comprising binder, colorant and, particles of a positively chargeable compound selected from the group consisting of nitrogen-containing organic compounds having 14 or more carbon atoms and an aryl group, organic phosphino compounds having 14 or more carbon atoms and represented the formula:

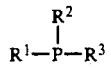

(wherein $R^1$, $R^2$ and $R^3$ are independently aryl or alkaryl), organic metal complexes having 14 or more carbon atoms and at least one amino group as a ligant, and organic metal compounds having 18 or more carbon atoms and a directly connected aryl group, excepting for quaternary ammonium and pyridinium salts, wherein the positively chargeable compound is soluble in an organic solvent and has an oxidation potential of 750 mV or below, a whiteness W of 0.5 or above, and an average particle size of 5.0 microns or less, at least 50% by number of said particles being at most 1/5 of an average particle size of said toner.

10. The method according to claim 9, wherein said latent image-bearing member comprising a photosensitive material layer and the electrostatic latent image is formed on the latent image-bearing member by irradiating a laser beam from a semiconductor laser onto the surface thereof.

11. The toner according to claim 1, wherein said colorant is a magnetic material.

12. The toner according to claim 11, wherein said magnetic material is contained in the toner in an amount of about 20 to 200 wt. parts per 100 wt. parts of resin component.

13. The toner according to claim 1, which is mixed with hydrophobic colloidal silicon treated with amino-silicone oil.

14. The method according to claim 9, wherein said colorant is a magnetic material.

15. The method according to claim 14, wherein said magnetic material is contained in the toner in an amount of about 20 to 200 wt. parts per 100 wt. parts of resin component.

16. The method according to claim 9, which is mixed with hydrophobic colloidal silica treated with amino-silicone oil.

* * * * *

UNITED STATES PATENT AND TRADEMARK OFFICE

CERTIFICATE OF CORRECTION

PATENT NO. : 5,071,727

DATED : December 10, 1991

INVENTOR(S) : Takeshi Ikeda et al.

It is certified that error appears in the above-identified patent and that said Letters Patent is hereby corrected as shown below:

COLUMN 1:

Line 7, "division," should be deleted.

COLUMN 2:

Line 8, "system," should read --system--;
Line 48, "properly" should read --property--;
Line 66, "dot" should read --dots.

COLUMN 3:

Line 28, "the" should read --and the--;
Line 40, tain" should read --taining--.

COLUMN 4:

Line 46, "positive" should read --positively--.

COLUMN 5:

Line 2, "triboelectricallly" should read --tribo-electrically--;
Line 64, "level" should read --levels--.

COLUMN 6:

Line 4, "priter," should read --printer,--;
Line 15, "altion" should read --lation--;
Line 45, "Vs-Vp" should read --Vs-Dp--;
Line 62, "in" should be deleted.

UNITED STATES PATENT AND TRADEMARK OFFICE

CERTIFICATE OF CORRECTION

PATENT NO. : 5,071,727

DATED : December 10, 1991

INVENTOR(S) : Takeshi Ikeda et al.

It is certified that error appears in the above-identified patent and that said Letters Patent is hereby corrected as shown below:

COLUMN 8:

Line 41, "When a" should read --A--.

COLUMN 9:

Line 23, "out" should read --our--;
Line 36, "form" should read "from--.

COLUMN 11:

Line 1, "granidine" should read --guanidine--;
Line 3, "phorphous-containing" should read --phosphorus-containing--;
Line 6, "Example" should read --Examples--;
Line 50, "cya-" should read -- cyc- --.

COLUMN 13:

Line 48, "accentuate" should read --accentuates--.

COLUMN 14:

Line 45, "Alaternatively," should read --Alternatively,--.

COLUMN 16:

Line 20, "particles" should read --particles,--.

UNITED STATES PATENT AND TRADEMARK OFFICE

CERTIFICATE OF CORRECTION

PATENT NO. : 5,071,727

DATED : December 10, 1991

INVENTOR(S) : Takeshi Ikeda et al.

It is certified that error appears in the above-identified patent and that said Letters Patent is hereby corrected as shown below:

COLUMN 17:

Line 60, "fluction" should read --fluctuation--.

COLUMN 19:

Line 55, "micron" should read --microns--.

COLUMN 20:

Line 25, "bu" should read --by--;
Line 36, "coying" should read --copying--;
Line 38, "charge" should read --change--.

COLUMN 21:

Line 46, "Hoechest" should read --Hoechst--

COLUMN 22:

Line 50, "the" should read --by the--;
Line 59, "ligant," should read --ligand,--.

UNITED STATES PATENT AND TRADEMARK OFFICE

CERTIFICATE OF CORRECTION

PATENT NO. : 5,071,727 Page 4 of 4

DATED : December 10, 1991

INVENTOR(S) : Takeshi Ikeda et al.

It is certified that error appears in the above-identified patent and that said Letters Patent is hereby corrected as shown below:

COLUMN 24:

Line 2, "silicon" should read --silica--.

Signed and Sealed this

Thirteenth Day of July, 1993

Attest:

Michael K. Kirk

MICHAEL K. KIRK

Attesting Officer

Acting Commissioner of Patents and Trademarks